United States Patent [19]

Rouleau et al.

[11] Patent Number: 4,952,203

[45] Date of Patent: Aug. 28, 1990

[54] PROCESS AND APPARATUS FOR PAIRING A FRONT AND REAR PANEL OF A T-SHIRT

[76] Inventors: Patrick Rouleau, 52, boulevard Carnot; Alain Rouleau, 3, rue Espinasse, both of 31000 Toulouse; Jean-Pierre Touret, Route de Menville - Brext, 31530 Levignac, all of France

[21] Appl. No.: 361,911

[22] Filed: Jun. 6, 1989

[30] Foreign Application Priority Data

Jun. 7, 1988 [FR] France ..... 8807957

[51] Int. Cl.[5] ..... B65H 39/043; B65H 3/44; D05B 33/00

[52] U.S. Cl. ..... 493/480; 493/379; 493/938; 270/58; 271/175; 112/121.29; 112/262.3; 112/DIG. 3

[58] Field of Search ..... 112/104, 121.29, 262.3, 112/DIG. 2, DIG. 3; 270/52, 58; 271/9, 20, 175; 493/379, 480, 937, 938

[56] References Cited

U.S. PATENT DOCUMENTS

| | | | |
|---|---|---|---|
| 3,099,970 | 8/1963 | Hite | 112/2 |
| 3,143,091 | 8/1964 | Arrter | 112/2 |
| 3,704,884 | 12/1972 | Nicolay et al. | 271/175 |
| 3,964,953 | 6/1976 | Mitchard et al. | 493/379 |
| 4,144,825 | 3/1979 | Angele et al. | 112/121.29 |
| 4,664,367 | 5/1987 | Vergnetti | 271/175 |
| 4,850,948 | 7/1989 | Schmitz | 493/379 |

*Primary Examiner*—William E. Terrell
*Attorney, Agent, or Firm*—Harold H. Dutton, Jr.

[57] ABSTRACT

The invention relates to a process and an apparatus for pairing up at least two flexible sheets, in particular the front and rear panels of an article such as a T-shirt. The process comprises forming a stack of each type of sheets and arranging these stacks on two plates (2, 3), picking up along a line, at least one sheet of each stack by means of two gripper assemblies (7, 8) displaceable above the plates (2, 3) between a lower sheet gripping position and an upper position in which the gripped sheets are suspended above the plates, moving a deposit member (15) above the plates (2, 3) along a trajectory in which the deposit member comes into contact with the gripped sheets while sliding therealong to a position intermediate their height, and actuating the gripper assemblies (7, 8) so as to release the sheets on the deposit member (15).

13 Claims, 7 Drawing Sheets

PROCESS AND APPARATUS FOR PAIRING A FRONT AND REAR PANEL OF A T-SHIRT

This invention relates to a process for picking up in pairs at least two flexible layers, in particular front and rear panels of an article such as a T-shirt, in the textile and knitted goods industry. The invention also relates to an apparatus for pairing up at least two such layers for carrying out the process.

BACKGROUND AND OBJECTS OF THE INVENTION

Presently, the back and front panels of T-shirts are conventionally paired up manually in order to be sewn together for forming the article. This pairing operation is lengthy, delicate and laborious because the panels are of large dimension, the layers tend to cling together, and the layers have a tendency to wrinkle or pucker when one tries to pick them up. The worker is therefor obliged to grasp the panels, raise his arms, and shake the panels in order to spread them out and to arrange one upon the other correctly.

The present invention seeks to overcome these drawbacks and provide a process and an apparatus permitting gripping the flexible sheets in a completely automatic manner, without any manual intervention.

DESCRIPTION OF THE INVENTION

To this effect, the process according to this invention comprises:

forming a stack of each type of layers and arranging these stacks on two plates, gripping along a line at least one layer of each stack by means of two gripping assemblies, each above one of the plates, movable between a lower layer gripping position and an upper position in which the gripped layers are suspended above the plates, moving a depositing member above the plates to a height between the plates and the gripping assemblies in their upper position and along a trajectory in which the depositing member comes into contact with the gripped layers while sliding therealong to a position intermediate the height, and actuating the gripping assemblies in such a manner as to release the layers onto the depositing member.

This process therefor permits, in a completely automatic manner, the gripping of two layers, pairing them, and depositing them on a depositing member upon which the operator only has to grasp the layers to sew them along their edges or seams.

According to a preferred embodiment, the stacks are placed on two inclined plates arranged in the manner of an open dihedron with their lower edges facing, and displacing the gripping assemblies perpendicularly to the lower edges.

The layers are thus gripping along one of their lower edges and raised in a direction making an acute angle with respect to the surface of the layers. These arrangements permit reducing the risks of gripping of lower layers by friction, since the fabric is not gripped tangentially to the other layers, but on the contrary is caused to unroll during the raising of the gripping assemblies.

Further, according to another characteristic of the invention, the layers are kept on the plates, adjacent the lower edges thereof, by a simple pressure permitting sliding and gripping of the upper layer, and then blowing a strem of air toward the lower edges. This arrangement permits, in effect, the elimination of wrinkles in the layers underlaying the gripped layer.

Preferably, the layer are gripped by means of grippers provided with a gripping face and displacing them in synchronism, causing the grippers to pivot, at the end of the raising movement of the gripping assemblies, in such a manner as to arrange their gripping faces in opposition, and bringing the gripped layers essentially edge to edge.

The invention also relates to a pairing apparatus for pairing at least two flexible layers, in particular the front and back of an article such as a T-shirt, in the textile and knitted goods industries, characterized in that it comprises in combination:

two plates provided with means for holding and positioning of a stack of layers, two gripping assemblies, each associated with actuating means and each arranged above one of the plates, the assemblies being adapted to grip at least one layer from the stack arranged on the plate and to release that layer upon command, means for moving the gripping assemblies adapted to displace said assemblies above the plates, between a lower layer gripping position and an upper position in which the assemblies are at a predetermined height above the plates, a depositing member movable so as to be arranged in an intermediate plane between the plates and the gripping assemblies in the upper position, means for moving the depositing member to a position above the plates, between a retracted position in which it is positioned above one plate and a deposit position in which it is positioned above a second plate.

DESCRIPTION OF THE DRAWINGS

Other characteristics, objects and advantages of the invention will become apparent from the following detailed description, with reference to the accompanying drawings which show, by way of non-limiting example, one preferred embodiment. In the drawings which form an integral part of the present description.

DESCRIPTION OF PREFERRED EMBODIMENTS

Figure 1:
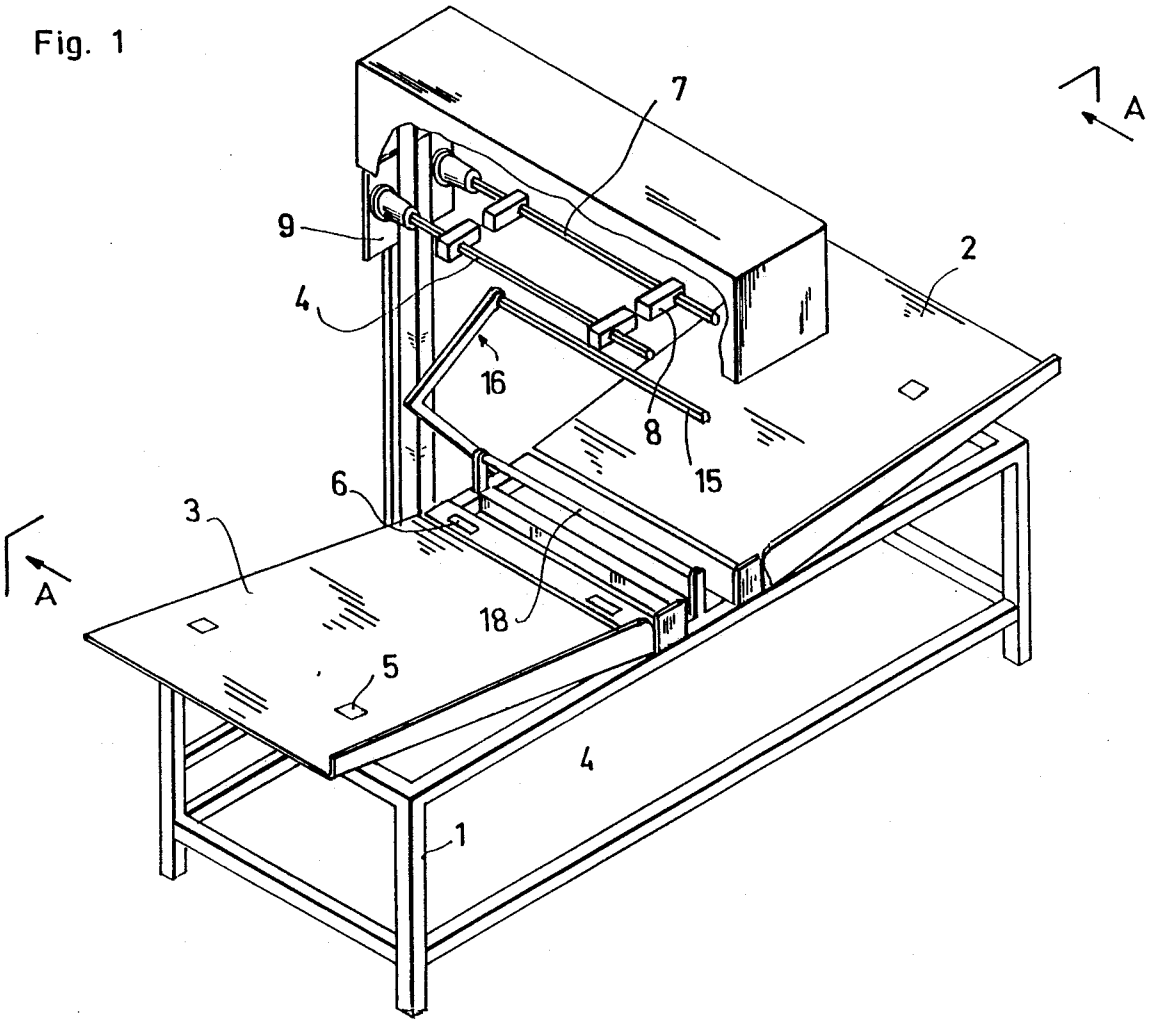
FIG. 1 is a perspective view of an apparatus conforming to the invention, with a covering part being removed for clarity.
Figure 2:
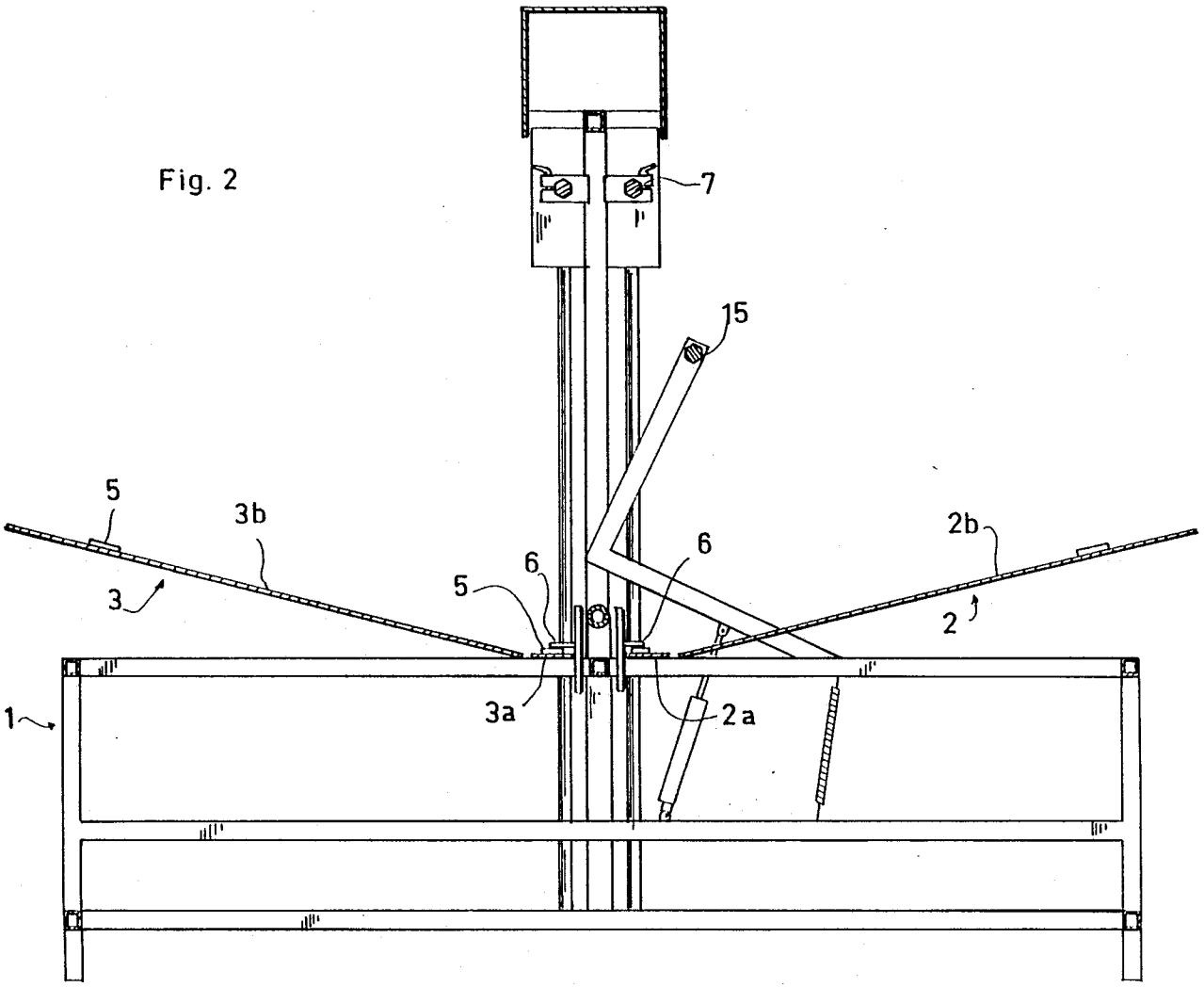
FIG. 2 is a longitudinal cross-section through a vertical plane A—A.
Figure 3:
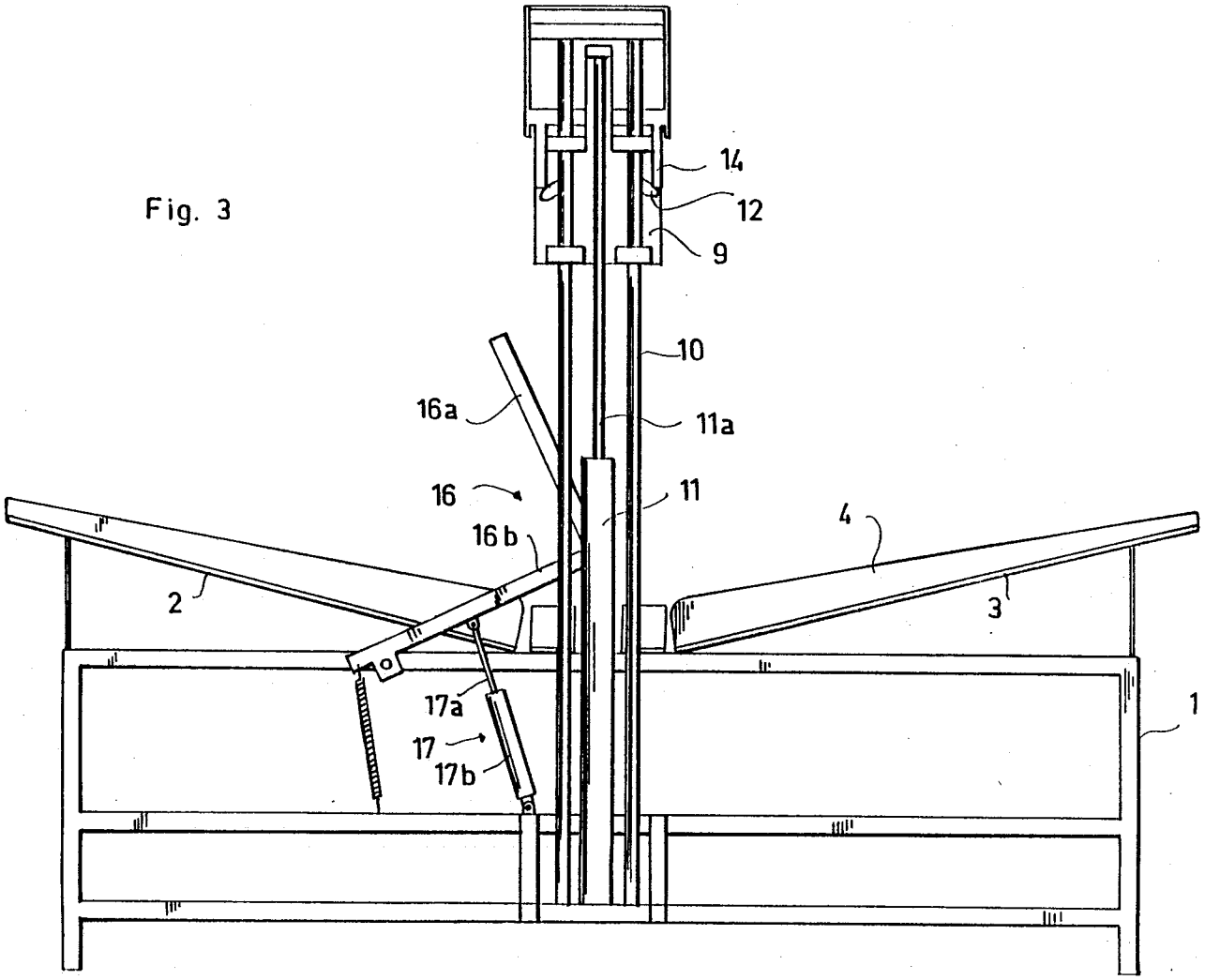
FIG. 3 is a rear view.

The machine shown in FIGS. 1 through 3 is intended to pair up two flexible layers such as a front and a rear panel for making of a T-shirt.

This machine comprises, firstly, a support chassis 1 supporting two fixed plates 2, 3, each intended to support a stack of the fabric layers. These plates 2, 3 are slightly inclined one toward the other in the shape of an open dihedron with their lower edges facing.

The plates include a lower part 2*a*, 3*a* which are horizontal and of relatively short length, and upper parts 2*b*, 3*b* inclined at an angle on the order of 15° to 25° with respect to the horizontal.

Each plate 2, 3 comprises a longitudinal edge provided with a positioning side 4 for the stack of sheets, and with holding members for this stack. These holding members comprise hooking strips 5 arranged on the plates in order to avoid sliding of the stack, and bars 6 arranged perpendicularly to the lower edge of the plates and guided vertically in order to achieve a pinching from their own weight of a longitudinal edge of the sheets.

Above the lower edge of these plates are arranged two gripper-carrying bars 7 adapted to be displaced vertically between an upper position and a lower gripping position.

Each of these bars 7 carries two grippers 8 such as are described in French patent 84.04804 or certificate of addition No. 88.06752, spaced one from the other so as to grip each layer in the vicinity of its angle. The position of one of these grippers 8 is adjustable along the bare 7 for permit operation on different widths of layers.

The two gripper carrying bars 7 are supported at their ends by a vertical support plate 9 slidingly mounted along two vertical guide rods 10. The support plate 9 is itself fixed to the rod 11*a* of a pneumatic jack 11 arranged vertically and adapted to displace the gripper carriers 7 between their upper and lower positions.

The pivoting means is adapted to cause the gripper carriers 7 to pivot around their longitudinal axes so as to permit positioning the grippers 8 either face to face, with their gripping faces being situated in immediate proximity, or oriented downwardly, with their gripping faces being turned toward the plates 2, 3.

Figure 5:
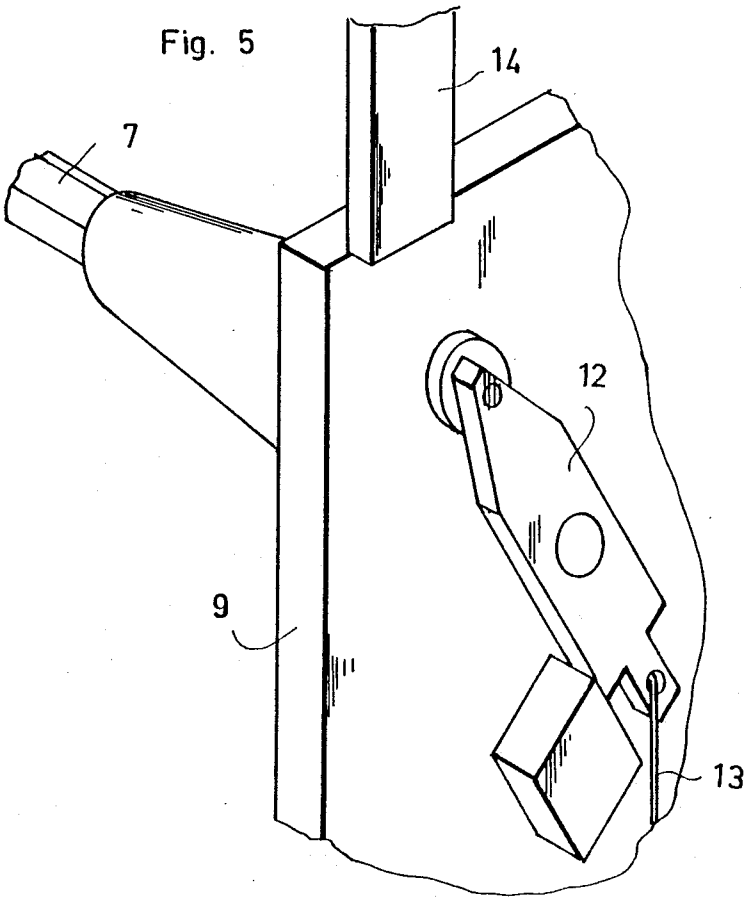
FIGS. 4 and 5 are partial perspective views of means for pivoting the gripper-carrying arms, in each of their two states of operation.
Figure 4:
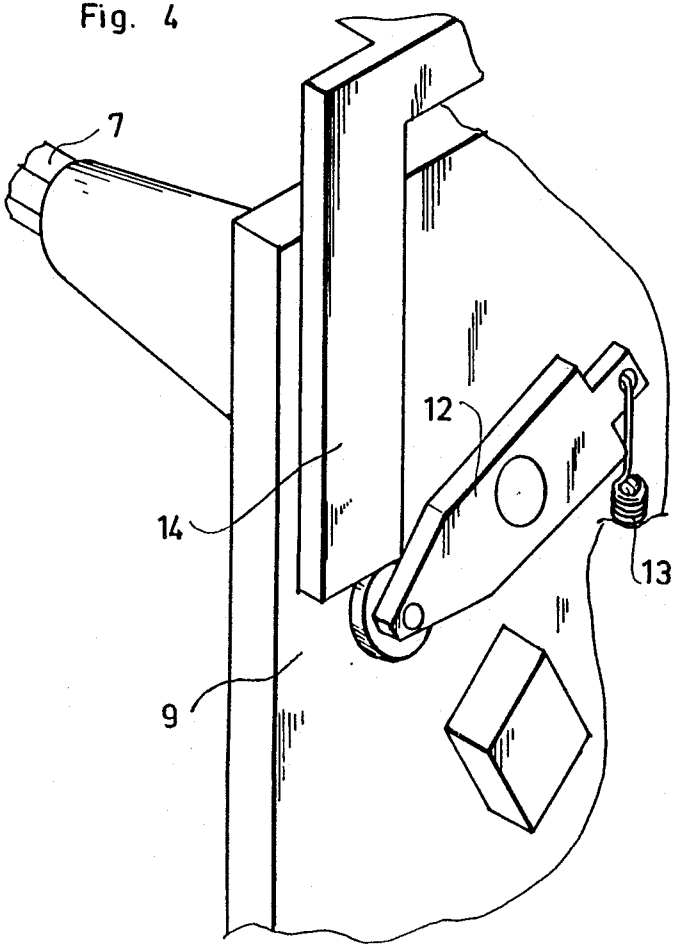

As is shown in FIGS. 4 and 5, this pivoting means comprises two cams 12 secured to the end of one gripper carrying bar 7 and arranged against the rear face of the support plate 9. Each cam is associated with a spring 13 adapted to keep it in a position corresponding to an orientation toward the base of the gripper faces 8, when the gripper carrying bars 7 are in the lower position or in the process of being raised or lowered (FIG. 5).

By contrast, at the end of the raising, each cam 12 comes into contact with a fixed upper stop plate 14 which automatically causes its rotation a quarter turn, and as a result the rotation of the gripper carrying bars 7 (FIG. 4).

The machine for pairing the sheets comprises also a deposit bar 15 arranged transversely above the plates 2, 3 and adapted to move back and forth above one plate 3 or to come above the other plate 2 into a deposit position, along a trajectory in which it comes into contact with the gripped sheets hung vertically from the grippers 8.

This deposit bar 15 is fixed near one of its ends to the end of one arm 16*a* of the L-shaped arm 16, the other arm 16*b* of which is articulated, in its median portion, to the rod 17*a* of a pneumatic cylinder 17, the body 17*b* of which is articulated on the support chassis 1, and near its end, on the support chassis 1.

This pairing machine comprises further a blowing nozzle 18 arranged between the plates 2, 3 slightly above the plates. This nozzle 18 is intended to blow air toward the two gripped sheets when they are lifted, so as to eliminate undulations which could be produced.

Finally, the sheet pairing machine comprises a central unit programmed to direct actuation according to the sequences shown in FIGS. 6*a* through 6*h*.

Figure 6A:
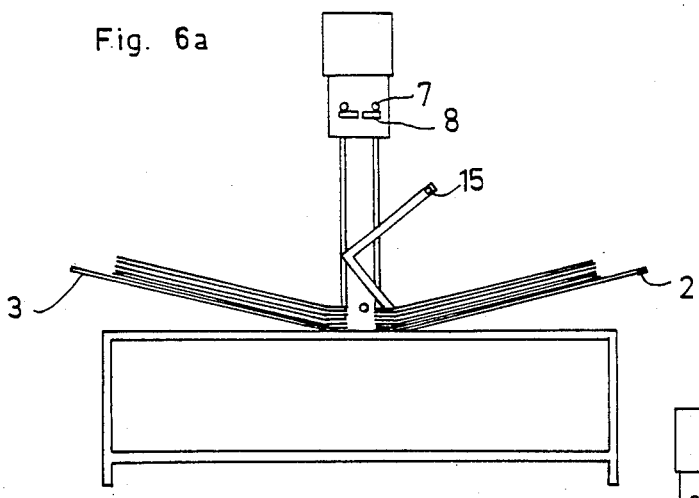
FIGS. 6*a* through 6*h* are schematic view showing the operation of a pairing cycle for two layers.

At the end of a cycle, and as shown in FIG. 6*a*, the gripper carrying bars 7 are in their upper position, the grippers 8 being automatically face to face, in the depositing position. Moreover,the deposit bar 15 is in the active position above one of the plates 2, within reach of the operator who can grasp the paired sheets.

Figure 6B:
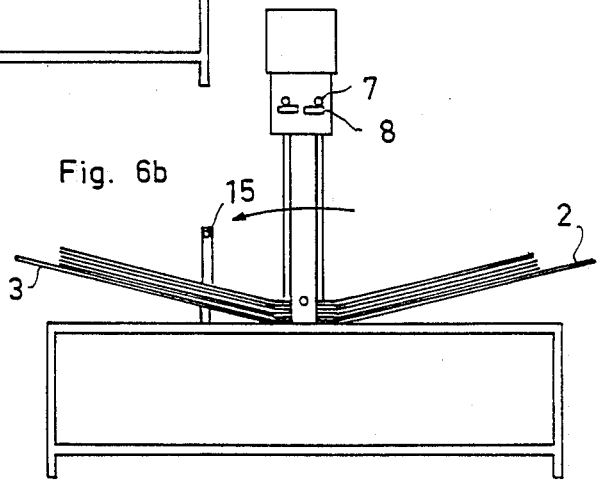
Figure 6C:
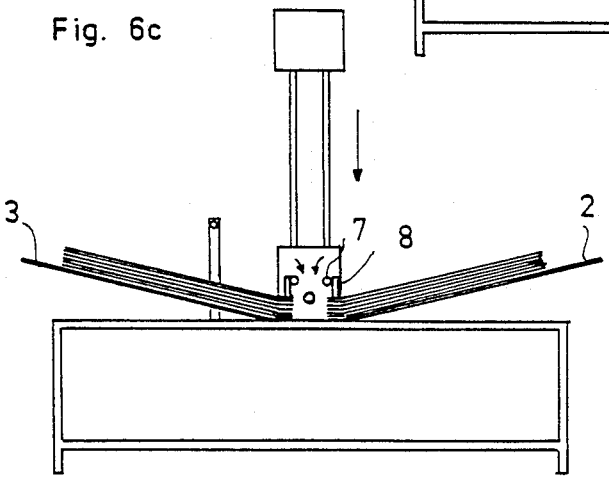
Figure 6D:
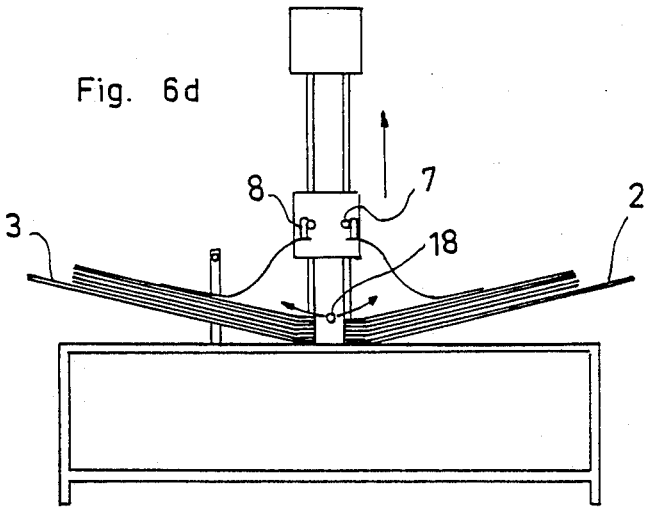

At the beginning of the cycle, the deposit bar 15 moves toward the other plate 3, while passing below the gripper carrying bars 7 (FIG. 6*b*).

These gripper carrying bars 7 are then subjected to a descending movement, during which the grippers 8 pivot automatically one quarter turn, until the grippers come into contact with the layers of fabric and automatically grip the upper layer as described in French patent 84.04804 or certificate of addition 86.02951, or the application for the certificate of addition 88.06752.

The gripper carrying bars 7 are then caused to raise toward their initial position (FIG. 6*d*), while lifting each layer along a direction making an acute angle of 65 to 75 degrees with respect to the surface of the stacked layers. due to the inclination of the plates 2, 3. Thus, any risk of carrying the lower layers by friction is reduced, while the fabric is drawn, not tangentially to the other layers, but on the contrary, is caused to unroll in a aline during raising of the grippers 8.

It should be noted further that the presence of the blower nozzle 15 blowing toward the gripped layers while they are being raised permits elimination of eventual undulations.

Figure 6E:
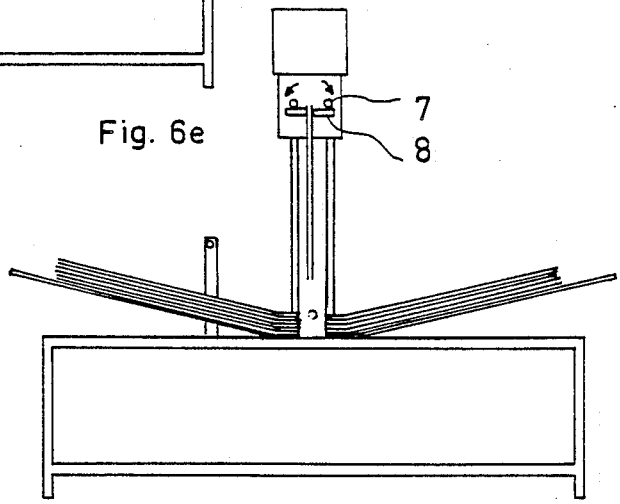

At the end of the raising of the gripper carrying bars 7, the cams 12 return to contact with the upper stop plate 14, causing a rotation of these bars around their axes, which brings the two sheets together and leads them essentially edge to edge (FIG. 6*e*).

Figure 6F:
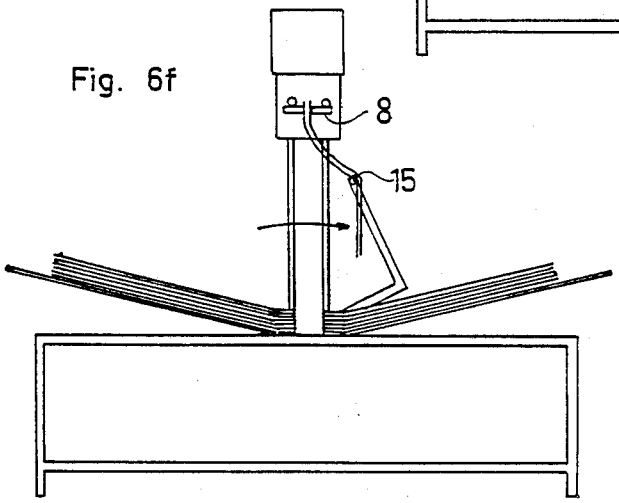

The deposit bare 15 then returns toward the other plate 2 while coming into contact with the gripped sheets hung vertically from the grippers 8, and while sliding along these sheets to a position intermediate their height (FIG. 6*f*).

Figure 6G:
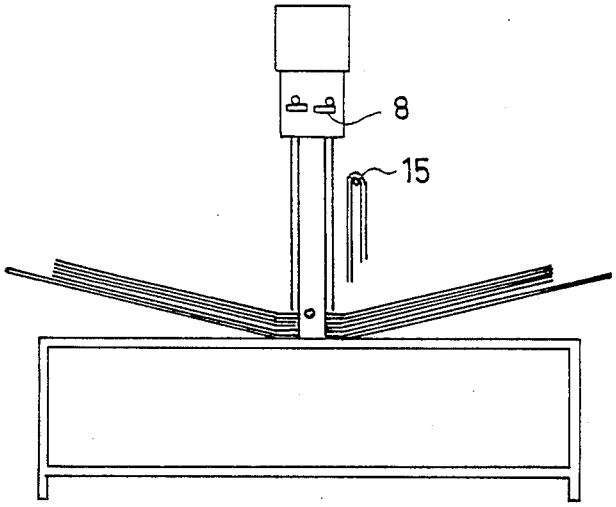

Lastly, the grippers 8 are actuated, as described in French patent No. 84.04804 or certificate of addition No. 88.06752, so as to release the sheets which are positioned on both sides of the deposit bar 15, precisely paired up along their height (FIG. 6*g*).

Figure 6H:
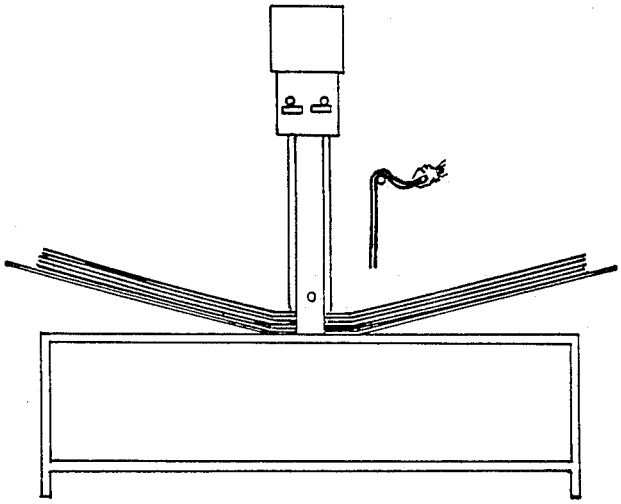

An operator may then grasp these sheets for sewing them along their edges (FIG. 6*h*).

While this invention has been described with reference to certain preferred features and embodiments, it will be understood that it is capable of further variation and modification without departing from the spirit of the invention, and this application is intended to cover any and all variations, modifications and adaptations of the invention which fall within the spirit of the invention and the scope of the appended claims.

I claim:

1. A process for pairing at least two flexible sheets of textile or knitted goods comprising forming a two stacks of the sheets to be paired and arranging said stacks on two plates (2, 3), gripping along a line at least one sheet from each stack by means of two movable gripper assemblies (7, 8) each sheet above one plate (2, 3) and moving said gripping assemblies between a lower gripping position of the sheets and an upper position where the gripped sheets are suspended above the plates (2, 3), moving a deposit member 15 above the plates (2, 3) to an intermediate height between said plates and the gripper assemblies (7, 8) in the upper position, and along a trajectory in which said deposit member comes into contact with the gripped sheets while sliding therealong to a position intermediate their height, and actuating the gripper assemblies (7, 8) so as to release the sheets onto the deposit member (15).

2. A process as in claim 1 and including placing said stacks on two inclined plates (2, 3) arranged as an open dihedron with their lower edges facing, and displacing said gripper assemblies (7, 8) perpendicularly to said lower edges.

3. A process as in claim 2 and including holding said sheets on said plates (2, 3) at the level of the lower edges thereof by pressure permitting the sliding and .gripping of the upper layer, and blowing air toward the lower edges in such a manner as to eliminate undulations of the underlying sheets of said gripped sheet.

4. A process as claim 3 and including gripping said sheets by means of grippers (8) having a face for gripping said sheets and displacing them synchronously, and pivoting said grippers at the end of the raising movement of the gripper assemblies (7, 8) so as to orient their gripper faces opposite each other and to bring the gripped sheets together essentially edge to edge.

5. An apparatus for pairing at least two flexible sheets of an article of textile or knitted goods, comprising in combination two plates (2, 3) having means (5, 6) for holding and positioning a stack of sheets thereon, two gripper assemblies (7, 8) and associated actuating means, each arranged above one plate, said assemblies being adapted to grip at least one sheet from a stack positioned on a plate and for releasing said sheet upon command, means (9, 10, 11) for causing translational movement of said gripper assemblies (7, 8) for displacing said gripper assemblies above the plates (2, 3), between a lower sheet gripping position and an upper position in which they are arranged at a predetermined height above said plates, a movable deposit member (15) positioned in an intermediate plane between the plates (2, 3) and the gripper assemblies (7, 8) in the upper position, and means (16, 17) for displacing the deposit member (15) for moving the deposit member above the plates (2, 3) between a retracted position above one plate and a deposit position above the other plate.

6. An apparatus as in claim 5 and wherein said plates (2, 3) are inclined and arranged as an open dihedron, with their lower edge facing, said means for causing translational movement of said gripper assemblies (7, 8) being adapted to displace said assemblies synchronously, essentially vertically from the lower edges of the plates (2, 3).

7. An apparatus as in claim 6, characterized in that it comprises blowing means (18) arranged between the lower edges of the plates (2, 3) essentially above the plates, and arranged to blow in the direction of said lower edges.

8. An apparatus as in claim 7 and wherein each gripper assembly comprises a gripper carrying bar (7) carrying at least two grippers (8) having a gripping face, means for controlling the relative position of said grippers along said gripper carrying bar and means for adjusting the raising as a function of the size of the sheets.

9. An apparatus as in claim 8 and including means (12, 13, 14) for pivoting the gripper carrying bars (7) around their longitudinal axes and for causing the pivoting of said bars between one position in which the gripper faces of the grippers (8) are opposite each other, and another position in which said gripper faces are opposite said plates (2, 3).

10. An apparatus as in claim 9 and including means for translationally moving said gripper assemblies (7, 8) comprising a cylinder (11) disposed vertically and having a rod (11*a*) carrying a support plate (9) on which are fixed, with a degree of rotational freedom, the ends of the gripper carrying bars (7), means for pivoting said gripper carrying bars (7) comprising two cams (12) secured to the ends of one of said bars, elastic means (13) arranged in such a manner as to keep said cams in a position corresponding to an orientation toward the base of the gripping faces of said grippers (8), and an upper stop member (14) arranged in such a manner as to cause the rotation of said cams at the end of withdrawal of the gripper assemblies (7, 8).

11. An apparatus as in claim 10 and including a central control unit programmed to actuate said apparatus according to the following sequences, starting from a state in which the gripper assemblies (7, 8) are in the upper position, the gripper faces being opposite each other, and the deposit member (15) in the deposit position: displacing the deposit member (15) toward its raised position; lowering the gripper assemblies (7, 8) until the gripper faces of the grippers (8) are in contact with the stacks of sheets, with rotation at the beginning of the fall of the gripper carrying bars (7) toward the position corresponding to a downward orientation of the gripping faces of the grippers (8), again raising the gripper assemblies (7, 8) toward their upper position with rotation at the end of the raising of the gripper carrying bars (7) toward the position corresponding to a face to face orientation of the grippers (8), displacing the deposit member (15) toward its deposit position along a trajectory where it comes into contact with the gripped sheets while sliding along these sheets, actuating the grippers (8) so as to deposit the gripped sheets on the deposit member (15).

12. An apparatus as in claim 6, and wherein each plate (2, 3) comprises a lower horizontal portion (2*a*, 3*a*) and an upper portion (2*b*, 3*b*) of greater length than said lower portion, each plate forming an angle between about 15° and 25° with respect to the horizontal.

13. An apparatus as in claim 5 and wherein each plate (2, 3) comprises a lateral edge having a positioning flange (4) for the stack of sheets.

* * * * *